United States Patent [19]

Fasching

[11] 4,453,950

[45] Jun. 12, 1984

[54] COAL GASIFICATION SYSTEM WITH A MODULATED ON/OFF CONTROL SYSTEM

[75] Inventor: George E. Fasching, Morgantown, W. Va.

[73] Assignee: The United States of America as represented by the United States Department of Energy, Washington, D.C.

[21] Appl. No.: 420,051

[22] Filed: Sep. 20, 1982

[51] Int. Cl.[3] ..... C10J 3/30

[52] U.S. Cl. ..... 48/86 R; 48/87; 414/161; 422/111

[58] Field of Search ..... 48/86 R, 87, 77, 210; 414/161, 296; 422/105, 106, 111, 114; 222/56; 110/101 CR, 185, 186

[56] References Cited

U.S. PATENT DOCUMENTS 4,170,311 10/1979 Spaw ..... 414/296

4,401,237 8/1983 Smith ..... 222/56

FOREIGN PATENT DOCUMENTS 135211 4/1979 Fed. Rep. of Germany ..... 48/210

*Primary Examiner*—Peter F. Kratz

*Attorney, Agent, or Firm*—David E. Breeden; Stephen D. Hamel; Michael F. Esposito

[57] ABSTRACT

A modulated control system is provided for improving regulation of the bed level in a fixed-bed coal gasifier into which coal is fed from a rotary coal feeder. A nuclear bed level gauge using a cobalt source and an ion chamber detector is used to detect the coal bed level in the gasifier. The detector signal is compared to a bed level set point signal in a primary controller which operates in proportional/integral modes to produce an error signal. The error signal is modulated by the injection of a triangular wave signal of a frequency of about 0.0004 Hz and an amplitude of about 80% of the primary deadband. The modulated error signal is fed to a triple-deadband secondary controller which jogs the coal feeder speed up or down by on/off control of a feeder speed change driver such that the gasifier bed level is driven toward the set point while preventing excessive cycling (oscillation) common in on/off mode automatic controllers of this type. Regulation of the bed level is achieved without excessive feeder speed control jogging.

5 Claims, 3 Drawing Figures

COAL GASIFICATION SYSTEM WITH A MODULATED ON/OFF CONTROL SYSTEM

BACKGROUND OF THE INVENTION

The present invention relates generally to automatic control systems of the on/off mode type and more specifically to improvements in on/off mode control systems for better regulation about the system set point.

A fixed-bed coal gasifier is used to produce low BTU gas from the partial combustion of granular coal. Coal is introduced into the reaction chamber above the reaction zone and must be maintained at a prescribed level above the zone to maintain the desired product gas quality.

A coal feeder of the pocket type is used to feed coal into a fixed-bed coal gasifier. The coal feeder is of the conventional rotating pocket type. The speed control of the pocket rotors of the feeder is by means of a variable sheave drive. The sheave effective diameter is changed to vary the speed ratio from a constant speed electric motor prime mover. The sheave diameter is varied by means of a positioner that is electric motor driven in an on/off control mode. By running the positioner motor in forward or reverse directions, the feeder speed is increased or decreased. When the positioner motor is stopped, the feeder speed is maintained. One problem associated with the variable speed drive for automatic control is that it can not withstand the frequent speed jogging that it would be subjected to when used in a conventional automatic control system. Frequent jogging would quickly wear out the drive system and electrical control contacts.

Another problem is that the characteristics of this type of system which uses on/off mode control is that it will not allow large integral action to be used in controlling about a set point due to the lag introduced by the inherent system deadband. In the described system, the 90° phase lag of the feeder/bed integrating response function causes control loop cycling (oscillation) when even a small amount of integral action is used.

Further, the disclosed system introduces an additional control problem due to the actuation of the gasifier stirrer approximately every 15 minutes, which corresponds to the stirrer vertical travel cycle time. This produces about a 20 percent variation in the nuclear level detector's output caused by shadowing from the stirrer and the shaft coupling the drive to the stirrer. Because of this large unavoidable cyclical variation, only a limited proportional action (gain $<1$) can be used without undue jogging of the feeder speed drive. A gain less than one without accompanying integral action causes a considerable offset (steady state difference between set point bed level and achieved bed level) that could normally be eliminated by adding integral action. How fast the offset is removed when integral action is used depends upon the integral rate in repeats/minute set in the controller. Also, the controller must have adequate combined proportional/integral action to react to load perturbations and upsets such that large changes will not occur in the controlled bed level. A combination of gain$=0.5$ and an integral rate of 0.05 repeats/minute is barely adequate but still cycles as will be shown hereinbelow. If integral action is reduced to eliminate cycling, then too little control action results or if proportional action is increased, excessive jogging of the feeder speed control occurs.

Thus, there is a need for improvements in control systems for on/off mode controllers to provide improved regulation and prevent cycling of the control loop.

SUMMARY OF THE INVENTION

In view of the above need, it is an object of this invention to provide an improved control system for use with an on/off mode controller which substantially reduces control system cycling.

Other objects, advantages, and novel features of the invention will be set forth, in part, in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects and in accordance with the purpose of the present invention, as embodied and broadly described herein, the device on/off mode control of a system operating parameter of this invention may comprise means for detecting the deviation of the system operating level by comparison with a set first level in a primary controller. The error signal from the primary controller is compared with the system parameter feed rate within a preselected deadband in a secondary controller which adjusts the feed rate in an on/off control mode to reduce the error signal. A modulating means is provided to modulate the error signal from the primary controller at a selected amplitude and frequency to substantially reduce cycling of the control system.

DETAILED DESCRIPTION

Figure 1:
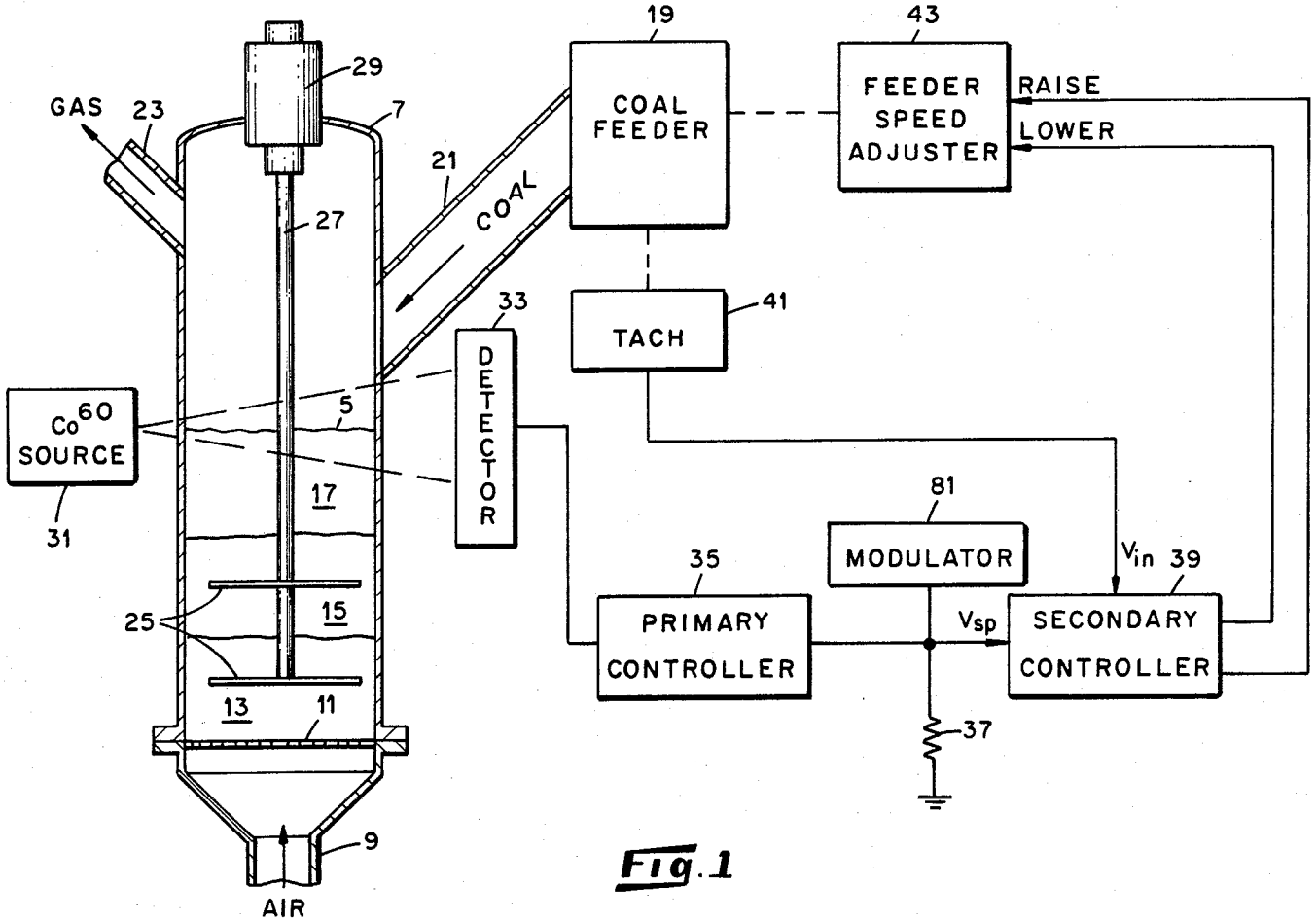
FIG. 1 is a schematic diagram of a bed level control system for a coal gasifier employing the on/off mode control system according to the present invention.

Referring now to FIG. 1 there is shown an on/off control system according to the present invention for use in controlling the coal bed level 5 of a coal gasifier 7. The gasifier 7 is of conventional design wherein air to support combustion is introduced through a bottom inlet 9. A grate 11 supports the bed above the air inlet. The bed includes an ash zone 13 immediately above the grate, a combustion zone 15 and a layer of coal 17 above the combustion zone which must be maintained at a preselected design level by varying the coal feed from a variable speed coal feeder 19 through a supply conduit 21. The product gas is taken off through a gas exit conduit 23.

The bed is continuously agitated by means of a stirrer 25 attached to a stirrer post 27. A stirrer drive mechanism 29 engages the post 27 at the top of the gasifier to both rotate and reciprocate the stirrer 25. The stirrer travels from just above the grate 11 to a point normally above the combustion zone 15 with a travel cycle of about 15 minutes.

As pointed out above, it is necessary to maintain the bed level constant for efficient operation. To accomplish this control in accordance with the present invention a conventional nuclear level gauge including a cobalt-60 radiation source 31 positioned on one side of the gasifier and a radiation detector 33 mounted on the opposite side of the gasifier is used to monitor the coal bed level. The gauge detects the degree of attenuation of the radiation by the bed. The detector is connected to produce a 1–5 volt output signal swing which is proportional to the bed level within the control range. The output of the detector is connected to the input of a proportional/integral controller 35, such as the Beckman Corp. model #8800, Fullerton, Calif. The detector 33 is mounted so that the output signal swing is centered about the desired bed level. In the example here the 1–5 volt swing corresponds to a bed level change between 74 and 84 inches elevation above the grate 11 with a control set point of 79 inches.

The controller 35 includes a means for adjusting the set point voltage for comparison with the input signal from the detector 33. The set point voltage in this example is 3.0 volts which corresponds to the 79 inch bed level. The controller is operated to provide a selected amount of proportional and integral action to reduce the undesirable control system cycling, as will be explained hereinbelow. The output signal from the controller 35 is an error signal in the form of a current signal which varies between 4–20 milliamps. This output error signal is fed to an output resistor 37 connected between the output of the primary controller 35 and ground potential. The resistor 37 is a 250-ohm resistor which produces an error signal voltage across it of 1–5 volts. This error signal varies inversely with the bed level in the selected control range.

The error signal voltage is connected to one input of a secondary controller 39 which is a specially designed controller having at least one deadband which compares the error signal voltage from the primary controller with a signal proportional to the speed of the coal feeder 19 from a tachometer 41. The tachometer is attached to detect the rotating speed of the coal feeder which is proportional to the rate of coal delivery to the gasifier. When the error signal deviates from the speed signal from the tachometer, which is selected to vary between 1–5 volts for the control range in this application, by more than half the deadband a comparator circuit within the secondary controller will close a contact to turn a coal feeder speed adjustor 43 "on" to either increase or decrease the coal feeder speed to raise or lower, respectively, the bed level within the gasifier.

The feeder speed adjustor 43 in this application is a positioner which is driven by a reversible electric motor to adjust the sheave diameter of a variable sheave drive mechanism of the coal feeder. The positioner motor will run in the direction it is switched on by the controller 39 until the comparator output signal is back within the deadband of the controller. The speed adjustor motor is then turned "off" and the adjusted coal feeder speed is maintained until the deviation swings out to the deadband limits again. Thus, as the output from the primary controller 35 changes due to an error in bed level, the control system changes the coal feeder speed and subsequently the coal feed rate to drive the measured bed level toward the set point level and to more closely match coal consumption rate in the gasifier bed. The coal consumption rate will vary with gas demand. In addition, the bed level is also upset by ash removal and by bed settling/lifting resulting from the stirrer 25 helical motion.

Figure 2:
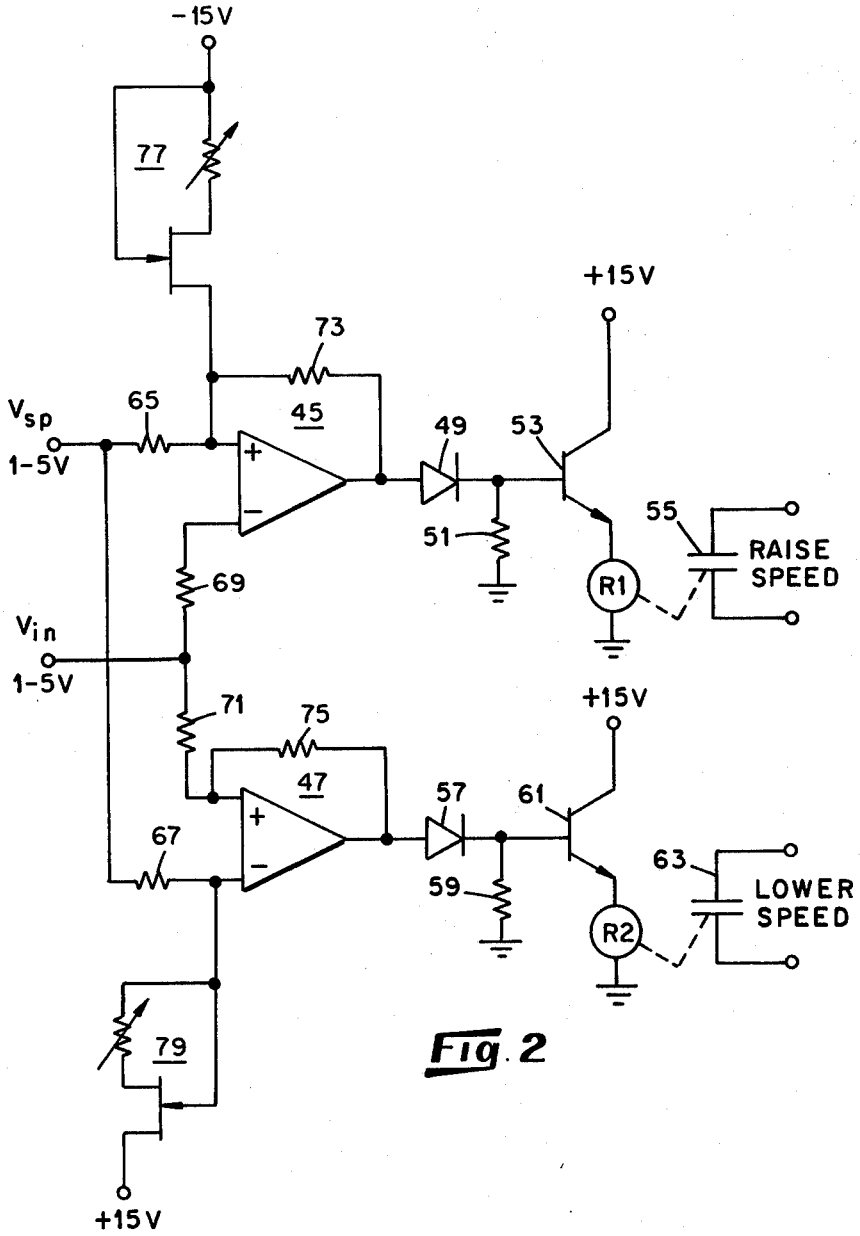
FIG. 2 is a schematic diagram of the secondary controller shown in block form in FIG. 1.

Referring now to FIG. 2 the secondary controller 39 will be described in detail. The circuit includes comparators 45 and 47 which control the raising and lowering, respectively, of the coal feeder speed. The comparator 45 is connected through a diode 49 and a load resistor 51 to ground potential. A positive voltage developed across the load resistor 51 when the output of the comparator goes positive is applied to the base of a transistor switch 53 turning it "on" and thereby activating a relay R1 coil to close the relay contacts 55. The contacts 55 are connected to the reversible motor controller of feeder speed adjustor 43 to run the motor in the forward direction so as to increase the coal feed rate.

Similarly, when the comparator 47 output goes positive the signal is applied through a diode 57, resistor 59 and transistor switch 61 to activate a relay R2 thereby closing the contacts 63 to run the speed adjustor motor in the reverse direction to lower the coal feed rate.

The non-inverting (+) input of comparator 45 is connected through a resistor 65 to receive the error voltage signal across resistor 37 at the output of the primary controller 35 (FIG. 1). This voltage signal is the set point, or reference, voltage ($V_{sp}$) for the secondary controller and is further applied through a resistor 67 to the inverting input (−) of comparator 47. The tachometer output voltage ($V_{in}$) is applied to the − input of comparator 45 through a resistor 69 and to the + input of comparator 47 through a resistor 71. The comparators 45 and 47 are connected in a positive feedback arrangement by connecting their outputs through resistors 73 and 75, respectively, to the + inputs. The comparators 45 and 47 are biased at their respective reference terminals by means of constant current circuit elements 77 and 79 connected in series with the input resistors 65 and 67. This voltage divider connection provides a positive bias on the (−) reference terminal of comparator 47 and a negative bias on the (+) reference terminal of comparator 45. This bias combined with the action of the positive feedback provides a triple deadband control arrangement wihch is centered about the $V_{sp}$ input voltage. For example, the voltage at the + terminal of comparator 45 is $V_{sp}$ minus the voltage drop across resistor 65 and the negative voltage feedback which is controlled by the ratio of the input resistance 65 to the feedback resistance 73. Therefore, as long as $V_{in}$ is greater than the voltage at the + input of comparator 45, the output of comparator 45 is negative and the relay contacts 55 remain open. When the bed level decreases to a point that $V_{sp}$ causes the + terminal of comparator 45 to become more positive than $V_{in}$, the − terminal voltage, the output of comparator 45 goes positive, activating relay R1 to close contacts 55 and raise the coal feeder speed. The feeder speed will increase until $V_{in}$ becomes more positive than the voltage at the + terminal of comparator 45. Due to the voltage hysteresis introduced by the positive feedback, $V_{in}$ must increase to a value greater than the voltage differential required to trip the comparator. Due to the slow integral action of the primary controller, $V_{sp}$ will remain essentially constant during the feeder speed adjustment. This action provides a 2nd deadband within the primary deadband so that the feeder speed is increased to a point well within the primary deadband limits.

Similarly, the comparator 47 is biased to control the speed lowering deadband limit by the fact that the voltage differential across comparator 47 is $V_{sp}$ plus the drop across resistor 67 and the positive feedback voltage applied to the + terminal of comparator 47. Thus, when $V_{sp}$ goes down to an increase of the bed level, it must go below $V_{in}$ by an amount greater than the bias placed across the comparator inputs before the − terminal of comparator 47 becomes less positive than the + terminal of comparator 47, to switch the output of comparator 47 positive and lower the feeder speed. Due to the positive feedback voltage hysteresis, $V_{in}$ must fall below the voltage differential required to trip the comparator 47, thereby creating a 3rd deadband within the primary deadband's upper voltage limit. Thus, it will be seen that the secondary triple deadband controller adjusts the feeder speed to hold it within the primary deadband limits.

It will be appreciated by those skilled in the art that the system may be operated with only the primary deadband for systems which do not require the additional control made available by the 2nd and 3rd deadbands. This is accomplished by eliminating the positive feedback resistors in the comparator circuits.

To prevent oscillations in the above-described system, the error signal ($V_{sp}$) from the primary controller 35 is modulated by means of a triangular wave modulator 81. The modulator signal is a current wave which flows through the load resistor 37. The current is about 3.2 milliamps peak-to-peak across the 250 ohm load resistor 37. This voltage signal is centered about the error signal $V_{sp}$ by utilizing bipolar symmetrical triangular current modulation having a zero average value.

Figure 3:
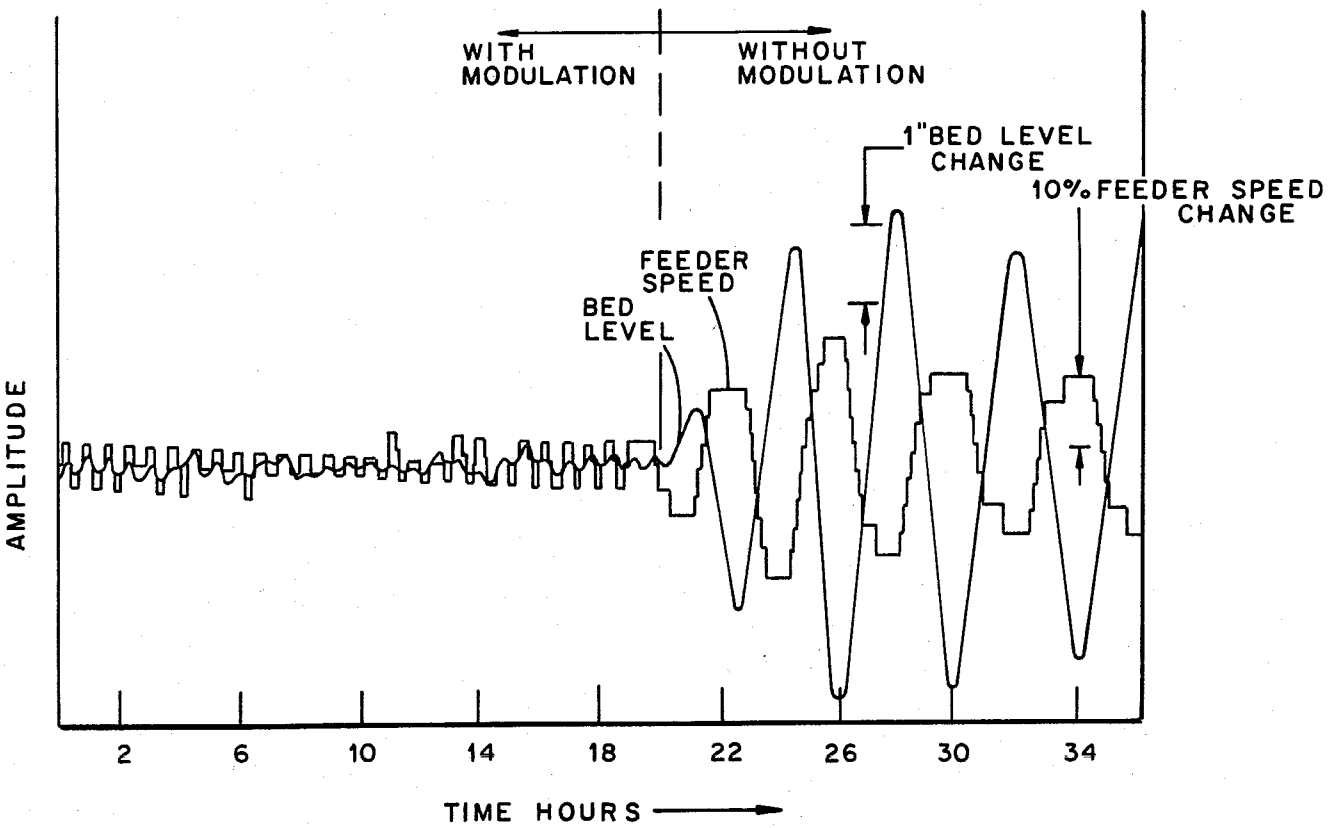
FIG. 3 is a plot comparing the fluctuation of coal feeder speed and bed level with and without the use of modulation of the primary controller error signal.

The proportional and integral action of the primary controller 35 is adjusted to obtain the best control of the system. However, the system continues to oscillate as shown in the righthand portion of FIG. 3. In the illustrated system, a combination of gain of 0.5 and an integral rate of 0.05 repeats/minute was found to provide the best control without the addition of the error signal modulation. Various modulation frequencies and amplitudes were examined from 0.0001 to 0.002 Hz and 0.5 to 1.0 volt peak-to-peak to optimize the response. The optimum modulation frequency was found to be about 0.0004 Hz with an amplitude of about 0.8 volt peak-to-peak. The result is shown in the lefthand portion of the plot of FIG. 3. The excessive cycling of the bed level and coal feeder speed is substantially elminated without excessive jogging of the coal feeder speed.

Thus, it will be appreciated that a control device for an on/off control system has been provided which improves regulation of a system variable operating parameter.

Although the invention has been illustrated for improvement in the control of bed level in a coal gasifier, it is also useful in almost any application for automatic control that uses on/off mode such as in electrical ovens, etc. It can provide much closer control without the large deviations caused by built-in deadbands (as in electrical heater oven controls to reduce wear and tear on contacts) and eliminate cycling (oscillation) occurring as a result of attempts by increasing integral (reset) action to obtain adequate control of a capacitive type process. For example, (1) the gasifier acts as a storage for mass (coal) or (2) an oven refractory/heated charge stores thermal energy similar to the way a capacitor stores electrical charge. A further specific application would be for household and industrial heating systems for better temperature regulation and in some cases improved energy efficiency. The frequency of the modulation signal for a particular system to be controlled would be selected at about six times the frequency of oscillation (cycling frequency) and the amplitude would be about 80% of the primary deadband.

The foregoing description of a preferred embodiment of the invention has been presented for purposes of illustration and description. It is not intended to be exhaustive or to limit the invention to the precise form disclosed, and obviously many modifications and variations are possible in light of the above teaching. The embodiment was chosen and described in order to best explain the principles of the invention as its practical application to thereby enable others skilled in the art to best utilize the invention in various embodiments and with various modifications as are suited to the particular use contemplated. It is intended that the scope of the invention be defined by the claims appended hereto.

What is claimed is:

1. A coal gasification system including an on/off mode control device for regulating a variable operating parameter of the system which is regulated by the system operating energy feed input rate from a feed supply means that is varied by a feed rate adjusting means in an on/off control mode, comprising:

detector means for detecting the deviation of said system operating parameter about a preselected operating level and generating an output signal proportional to said deviation, a primary controller connected to the output of said detector means for comparing the output signal from said detector with a set point valve signal coresponding to said preselected operating level to produce an error signal indicative of the deviation of said detector signal from said set point signal;

a rate detecting means operatively connected for detecting said energy input rate and generating a rate signal proportional thereto;

a secondary controller means operatively connected for comparing said rate signal with said error signal within at least one preselected deadband and switching said adjusting means on and off to change the feed rate of said feed supply means sufficient to bring said rate signal within said deadband when said deadband is exceeded; and a modulating means operatively connected for modulating said error signal at a selected amplitude and frequency to substantially reduce cycling of said control system and wherein said variable operating parameter is the coal bed level in a coal gasifier, said feed supply is a variable feed rate coal feeder having a feed rate adjusting means and wherein said detecting means for detecting the operating parameter deviation is a nuclear level gauge.

2. The system of claim 1 wherein said secondary controller means includes first and second comparators each having a reference input and a comparison input and an output which switches from a first state to a second state when the voltage at said comparison input exceeds the voltage at said reference input, said reference inputs connected to receive said error signal and said comparison inputs connected to receive said rate signal, means for applying predetermined bias voltages to said reference inputs of said first and second comparators, respectively, to provide a voltage deadband centered about the signal voltage applied to said reference input, a first output circuit means responsive to the output of said first comparator for turning said adjusting means "on" to change said feed rate in a forward direction wherein said first comparator switches from said first state to said second state, and a second output circuit means responsive to the output of said second comparator for turning said adjusting means "on" to change said feed rate in a reverse direction when said second comparator switches from said first state to said second state.

3. The system as set forth in claim 2 wherein said first and second comparators are connected in a positive feedback arrangement to provide additional voltage deadbands at the opposite bounds of said at least one deadband thereby providing a triple deadband controller.

4. The system as set forth in claim 3 wherein said modulating means includes a triangular wave-shaped signal generator for modulating said error signal at a modulation frequency and amplitude sufficient to substantially eliminate oscillations in said system.

5. The system as set forth in claim 4 wherein said primary controller is a proportional/integral action selectable controller.

* * * * *